United States Patent [19]

Smith et al.

[11] 4,436,689

[45] Mar. 13, 1984

[54] PROCESS FOR THE PRODUCTION OF POLYMER FILAMENTS HAVING HIGH TENSILE STRENGTH

[75] Inventors: Paul Smith, Wilmington, Del.; Pieter J. Lemstra, Brunssum, Netherlands; Robert Kirschbaum, Sittard, Netherlands; Jacques P. L. Pijpers, Limbricht, Netherlands

[73] Assignee: Stamicrabon B.V., Geleen, Netherlands

[21] Appl. No.: 434,829

[22] Filed: Oct. 18, 1982

[30] Foreign Application Priority Data

Oct. 17, 1981 [NL] Netherlands ..... 8104728

[51] Int. Cl.[3] ..... D01F 6/00

[52] U.S. Cl. ..... 264/204; 264/103; 264/205; 264/210.8

[58] Field of Search ..... 264/204–205, 264/210.8, 290.5, 103

[56] References Cited

U.S. PATENT DOCUMENTS

| | | | |
|---|---|---|---|
| 3,048,465 | 8/1962 | Jurgeleit | 264/205 |
| 4,268,470 | 5/1981 | Capaccio et al. | 264/176 F |
| 4,344,908 | 8/1982 | Smith et al. | 264/205 |

OTHER PUBLICATIONS

Kalb et al., "Hot Drawing of Porous High M. W PE", Polymer Bulletin I, pp. 879–880 (1979).

Smook et al., Polymer Bulletin 2, 775–783 (1980).

Smith et al., Polymer Bulletin 1, 733–736 (1979).

*Primary Examiner*—Jay H. Woo

[57] ABSTRACT

An improved process for the preparation of polymer filaments having a high tensile strength and modulus by spinning a solution of high-molecular weight polymer and thereafter stretching the filament thus formed. A solution of an ethylene polymer or copolymer, containing at least 80 percent by weight solvent, is spun at a temperature above the gel point of the solution. The ethylene polymer or copolymer contains at most about 5 percent by weight of an alkene having 3 to 8 carbon atoms, has a weight-average molecular weight Mw higher than $4\times10^5$ kg/kmole, and has a weight/number average molecular weight ratio Mw/Mn lower than 5. The spun polymer solution is thereafter cooled to a temperature below its gel point to form a gel filament, which gel filament is thereafter stretched to form a polymer filament having a tensile strength of at least about 1.5 GPa at room temperature.

15 Claims, No Drawings

PROCESS FOR THE PRODUCTION OF POLYMER FILAMENTS HAVING HIGH TENSILE STRENGTH

This invention relates to a process for the preparation of polymer filaments having high tensile strength by spinning a solution of high-molecular weight polymer and stretching or drawing the filaments thus formed.

Processes for producing polymer filaments of high modulus and high tensile strength are described by applicants Smith and Lemstra in their U.S. Pat. No. 4,344,908 and copending application Ser. No. 162,449 filed June 24, 1980. In these known processes, polyalkene polymers of very high molecular weights are used, and/or high degrees of stretching are applied.

It has now been found that filaments having tensile strengths and moduli comparable to these known processes can be obtained while using lower molecular weights and/or lower stretch or draw ratios, or that substantially higher tensile strengths and moduli can be obtained while using the same molecular weights and stretch ratios, if the filaments are spun from polymer solutions having a weight/number—average molecular weight ratio Mw/Mn which is lower than those applied in the known processes.

In the process of the present invention, a polymer filament having a high tensile strength and modulus is prepared by spinning a solution of a linear high-molecular weight polymer at a temperature above its gel point, cooling the spun polymer solution thus formed to a temperature below its gel point to form a gel filament, and stretching the resultant gel filament to form a polymer filament having a tensile strength of at least about 1.5 gigapascale (GPa) at room temperature. In one embodiment of the invention, the polymer solution contains at least about 80 percent by weight solvent (relative to the solution), and the polymer is an ethylene polymer or copolymer containing from about 0 to 5 percent by weight of at least one alkene having from 3 to 8 carbon atoms; has a weight-average molecular weight Mw higher than $4\times10^5$ kg/kmole; and has a weight/number average molecular weight ratio Mw/Mn lower than 5. By contrast, in the known processes noted above, the polyalkene polymers therein used, in particularly polyethylenes, have a Mw/Mn ratio in the range of between about 6.5 to 7.5 and above.

In another embodiment of the invention, the gel filament, after spinning and cooling to a temperature below its gel point, is twisted about its axis, simultaneously with the stretching, to form a filament having a tensile strength of at least about 1.5 GPa to room temperature.

Linear high-molecular weight ethylene polymers having the specific Mw/Mn ratios as required for this invention can be prepared by fractionating a polymer having a broader molecular weight distribution. In this regard, references made to the text Fractionation of Synthetic Polymers by L. H. Tung. Alternatively, ethylene polymers having this specific Mw/Mn ratio can be obtained directly by using specific catalyst systems and/or specific reaction conditions such as discussed in L. L. Bohn, Die Angewandte Makromolekulare Chemie 89 (1980), 1-32 (nr. 1910).

The process of the present invention permits a stretching process which is far more efficient that was possible in applying the processes previously known in the art, in that for the same E modulus, a substantially higher tensile strength is obtained than in the known processes.

The polymers to be applied in accordance with the present invention must be linear, and as used herein, the term linear shall be understood to mean that the polymer has an average of less than 1 side chain per 100 carbon atoms, and preferably less than 1 side chain per 300 carbon atoms.

The ethylene polymers may contain minor amounts, preferably at most about 5 percent by weight, of one or more other alkenes copolymerized therewith, such as propylene, butylene, pentene, hexene, 4-methylpentene, octene, and the like. The polyethylene materials applied may also contain minor quantities, preferably at most 25 percent by weight, of one or more other polymers, particularly an alkene-1 polymer, such as polypropylene, polybutylene, or a copolymer of propylene with a minor quantity of ethylene.

In accordace with the invention, the weight/number-average molecular weight ratio Mw/Mn of the ethylene should be less than 5. However, the specific advantages of the present invention are particularly evident in its preferred embodiment wherein ethylene polymers having a Mw/Mn ratio of less than 4 is used.

The polymer solution to be spun in accordance with this invention should contain at least 80 percent by weight solvent relative to the solution. Very low polymer concentrations in the solution, such as 2 percent by weight polymer, may be very advantageous when applying polymer or polymers having an ultra-high molecular weight, such as higher than $1.5\times10^6$ kg/kmole. Preferably, the ethylene polymer utilized in accordance with this invention will have a Mw in the range of between about $5\times10^5$ and $1.5\times10^6$ kg/kmole, and a Mw/Mn of less than 4. When using ethylene polymers within the preferred range, the polymer solution will preferably have a polymer concentration in the range of between about 2 percent by weight to 15 percent by weight for Mw values ranging from $1.5\times10^6$ to $5\times10^5$, respectively.

The choice of solvent employed to form the polymer solution of this invention is not critical. Any suitable solvent may be used, such as halogenated or non-halogenated hydrocarbons having the requisite solvent properties to enable preparation of the desired polyethylene solution. In most solvents, polyethylene is soluble only at temperatures of at least 90° C. In conventional spinning processes, the space into which the filaments are spun is under atmospheric pressure. Thus, low-boiling solvents are less desirable, because they can evaporate so rapidly from the filaments that they function more or less as foaming agents and interfere with the structure of the filaments.

When cooled rapidly, polymer solutions having a concentration within the range of the present invention will pass into a gel state below a critical temperature, that is, the gel point. This gel point is defined as the temperature of apparent solidification of the polymer solution when cooling. During spinning, the polymer must be in solution, and the temperature must, therefore, be above this gel point.

The temperature of the polyethylene solution during spinning is preferably at least 100° C., more specifically at least 120° C., and the boiling point of the solvent is preferably at least 100° C., more specifically at least equal to the spinning temperature. The boiling point of the solvent should not be so high as to make it difficult to evaporate it from the spun filaments. Suitable solvents are aliphatic, cycloaliphatic, and aromatic hydrocarbons having boiling points of at least 100° C., such as octane, nonane, decane, or isomers thereof, and higher straight or branched hydrocarbons, petroleum fractions with boiling ranges above 100° C., toluenes or xylenes, naphthalene, hydrogenated derivatives thereof, such as tetralin, decalin, and also halogenated hydrocarbons and other solvents known in the art. With a view toward low cost, preference will usually be given to non-substituted hydrocarbons, including hydrogenated derivatives of aromatic hydrocarbons.

The spinning temperature and the temperature of dissolution must not be so high as to lead to considerable thermal decomposition of the polymer. In general, the temperatures employed with ethylene polymer solutions will, therefore, not be above 240° C.

Although for purposes of simplicity, reference is made herein to the spinning of filaments, it should be understood that spinning heads having slit dyes can be used in the present process as well. The term "filaments" as used herein, therefore, not only comprises filaments having more or less round cross-sections, but also includes small ribbons produced in a similar manner. The benefits of the present invention are derived from the manner in which the stretched polymer structure is obtained, and the specific shape of the cross-section of such polymer structure, be it filament, tape, or otherwise, is not material to this invention.

After spinning, the spun polymer solution is cooled down to a temperature below the gel point of the solution to form a gel filament. This may be accomplished in any suitable manner, for instance by passing the spun polymer solution into a liquid bath, or through a chamber containing some other fluid capable of cooling the spun polymer solution to a temperature below the gel point at which the polymer will form a gel. The resulting gel filament then has sufficient mechanical strength to be processed further, for instance, by means of guides, rolls, and the like customarily used in the spinning techniques.

The gel filament (or a gel ribbon) thus obtained is subsequently stretched. During this stretching process, the gel may still contain a substantial quantity of solvent, for instance, nearly the entire quantity of solvent contained in the spun polymer solution itself. This will occur when the polymer solution is spun and cooled under such conditions as to not promote the evaporation of solvent, for instance by cooling the spun polymer solution to below its gel point in a liquid bath. Alternatively, a portion, or even essentially all, of the solvent can be removed from the gel filament prior to stretching, for instance by evaporation during or after cooling, or by washing-out the solvent with an extractant.

Preferably, the gel filament will still contain a substantial quantity of solvent during stretching, for instance more than 25 percent by weight, and preferably more than 50 percent by weight relative to the combined polymer and solvent. At higher solvent concentrations, it is possible to apply a higher final degree of stretching to the filament, and consequently a higher tensile strength and modulus can be obtained. However, under certain conditions it may be more advantageous to recover most of the solvent prior to stretching.

The polyethylene gel filaments are preferably stretched at a temperature of at least about 75° C., but preferably at a temperature below the melting point or dissolving point of the polyethylene. Above this latter temperature, the mobility of the macromolecules will become so high that the desired molecular orientation cannot be sufficiently effected. With polyethylene, the stretching process will generally be carried out at a temperature of at most about 135° C. In determining the appropriate temperature for stretching, the intramolecular heat developed as a result of the stretching energy expended on the filaments must also be taken into account. At high stretching speeds, the temperature in the filaments may rise considerably, and care should be taken that this temperature does not go above, or even come near, the melting point.

The filaments can be brought to the appropriate stretching temperature by passing them through a zone containing a gaseous or liquid medium which is maintained at the desired temperature. A tubular furnace containing air as a gaseous medium has been found very suitable, but a liquid bath or any other device appropriate for this purpose may also be used.

During the stretching process, any solvent remaining in the filament should be separated from the filament. This solvent removal is preferably promoted by appropriate means during the stretching, such as vaporizing and removing the solvent by passing a hot gas or air stream along the filament in the stretching zone, or by carrying out the stretching in a liquid bath comprising an extractant for the solvent, which extractant may optionally be the same as the solvent. The filament which is eventually obtained should be substantially free of solvent, and it is advantageous to apply such conditions in the stretching zone that the filament is free, or virtually free, of solvent by the time the filament exists from the stretching zone.

The moduli (E) and tensile strengths ($\sigma$) are calculated by means of force/elongation curves as determined at room temperature (about 23° C.) by means of an Instron Tensile Tester, at a testing speed of 100 percent stretching/Min. ($\epsilon = 1\ \text{min}^{-1}$), and reduced to the original diameter of the filament sample.

In applying the process of the present invention, high stretch ratios can be used. It has been found, however, that by using polymer materials having a low weight-/number-average molecular weight ratio Mw/Mn in accordance with the invention, polymer filaments having a considerable tensile strength can be already obtained if the stretched ratio at least equals $$\frac{\sqrt{Mw/Mn} \times 4 \times 10^6}{Mw} + 1$$

wherein the value of Mw is expressed as kg/kmole (or g/mole).

It has additionally been found that the tensile strengths and moduli of stretched high-molecular weight polymer filaments can be improved by twisting the filaments around their stretching axis during the stretching process. Accordingly, in another embodiment of the present invention, a solution of a linear high-molecular weight polymer of copolymer having at least 80 percent by weight solvent, relative to the polymer solution, is spun at a temperature above the gel point of that solution. The spun polymer solution is thereupon cooled to below its gel point, and the gel filament thus obtained is stretched and twisted around its axis while being stretched to form a filament having a tensile strength higher than 1.5 gigapascal (GPa). Preferably the linear speed of the filament through the stretching zone and the speed of rotation around its stretching axis will be adjusted such that the number of twists per meter of twisted filament, or twist factor, will be in the range of between about 100 to 5000 twists per meter, and most preferably in the range of between about 300 to 3000 twists per meter.

The gel filament subjected to the stretching and twisting process can either contain a substantial quantity of solvent, such as nearly the amount of solvent present in the spun polymer solution, or can be of reduced solvent content as discussed above. In accordance with this aspect of the invention, a twisted filament is obtained which has a reduced tendency toward fibrillation, and which has a substantially improved knot strength.

This further embodiment of the invention is generally applicable to any polyalkene gel, or any linear polymer gel such as, for instance, polyolefins such as polyethylene, polypropylene, ethylene-propylene copolymers, polyoxymethylene, polyethyleneoxide; polyamides, such as the various types of nylon; polyesters, such as polyethylene terephthalate, polyacrylnitrile; and vinyl polymers such as polyvinylalcohol and polyvinylidene-fluorine. Appropriate solvents for forming solutions of these polymers suitable for spinning are disclosed in U.S. Pat. No. 4,344,908, the disclosure of which is hereby incorporated by reference.

The filaments prepared in accordance with this invention are suitable for a variety of applications. They can be used as reinforcement in a variety of materials for which reinforcement with fibers or filaments is known, for tire cords, and for all applications in which low weight combined with high strength is desired, such as rope, nets, filter cloths, and the like.

If so desired, minor quantities, in particular quantities of from between about 0.001 and 10 wt.% relative to the polymer, of conventional additives, stabilizers, fiber treatment agents, and the like can be incorporated in or applied on the filaments.

The invention will be further elucidated by reference to the following examples, without, however, being limited thereto.

EXAMPLE 1

A high-molecular linear polyethylene having a Mw of about $1.1\times10^6$ kg/kmole and a Mw/Mn of 3.5 was dissolved in decalin at 106° C. to form a 2% by weight solution. This solution was spun in a water bath at 130° C. through a spinneret with a spinneret aperture having a diameter of 0.5 mm. The filament was cooled in the bath so that a gel-like filament was obtained still containing more than 90 percent solvent. This filament was stretched in a 3.5-meter-long stretch oven, in which air was maintained at 120° C. The stretching speed was about 1 $sec^{-1}$, and various stretch ratio between 20 and 50 were used. The moduli (E) and the tensile strengths ($\sigma$) were then determined for filaments stretched with different stretch ratio.

The value of the stretch ratios, moduli, and tensile strengths are shown in Table 1 and are compared with the values obtained for a polyethylene sample having the same Mw of $1\times1\times10^6$ kg/mmole but a Mw/Mn of 7.5, which sample was stretched with different stretch ratios and otherwise treated under comparable conditions.

TABLE 1

Processing of polyethylene having a Mw of $1.1\times10^6$ kg/kmole to form filaments.

A. According to the process of the invention: Mw/Mn = 3.5.

B. According to the known state of the art: Mw/Mn - 7.5.

| Stretch ratio λ | | Modulus E (GPa) | | Tensile Strength σ (GPa) | |
|---|---|---|---|---|---|
| Mw/Mn 3.5 | Mw/Mn 7.5 | Mw/Mn 3.5 | Mw/Mn 7.5 | Mw/Mn 3.5 | Mw/Mn 7.5 |
| 18 | — | 35 | — | 1.6 | — |
| — | 25 | — | 52 | — | 1.8 |
| 25 | — | 60 | — | 2.4 | — |
| — | 40 | — | 80 | — | 2.5 |
| — | 45 | — | 90 | — | 2.7 |
| 45 | — | 91 | — | 3.0 | — |

EXAMPLE 2

Under essentially the same processing conditions as described in Example 1, except that 8% by weight solutions were used, a polyethylene sample having a Mw of about 500,000 kg/kmole and a Mw/Mn of 2.9 and a polyethylene sample having a Mw of about 500,000 kg/kmole and a Mw/Mn of 9 were processed to form filaments and compared.

TABLE 2

Processing of polyethylene having a Mw of 500,000 kg/kmole to form filaments.

A. According to the process of the invention:

$$\frac{Mw}{Mn} = 2.9$$

B. According to the known state of the art:

$$\frac{Mw}{Mn}\ 9$$

| Stretch ratio λ | | Modulus E (GPa) | | Tensile strength σ (GPa) | |
|---|---|---|---|---|---|
| Mw/Mn 2.9 | Mw/Mn 9 | Mw/Mn 2.9 | Mw/Mn 9 | Mw/Mn 2.9 | Mw/Mn 9 |
| — | 22 | — | 32 | — | 0.9 |
| 22 | — | 37 | — | 1.3 | — |
| — | 36 | — | 61 | — | 1.5 |
| 37 | — | 60 | — | 1.9 | — |

EXAMPLE 3

Twisting of a Polyethylene Gel Filament During Stretching

According to the solution spinning process described under Example 1, a gel filament was spun from a 2% by weight solution of polyethylene having a Mw of $3.5\times10^6$ kg/kmole in decalin. After drying, the virtually solventless filament was stretched at 130° C. and simultaneously twisted around its stretching axis by securing one end of the filament in a rotating body and by moving the other end away from the rotating body at a speed of 10 cm/min. The speed applied was 280 rpm, which resulted in a twist factor of about 2500 twists per meter of material stretched. The properties perpendicular to the fiber axis were strongly improved by this combined stretch-twist, which is evident from the increased knot strength, while the tensile strength remained virtually unchanged. The following Table 3 compares the knot strengths, and the tensile strengths of twisted and non-twisted filaments stretched with a degree of stretching of 12 times and of 18 times.

TABLE 3

| Stretch twisting of polyethylene filaments having a Mw of $3.5 \times 10^6$ kg/kmole. | | | |
|---|---|---|---|
| | Degree of stretching λ | Non-twisted | Twisted |
| Tensile strength (GPa) | 12 | 1.0 | 1.0 |
| | 18 | 1.6 | 1.7 |
| Knot strength knot (GPa) | 12 | 0.5 | 0.7 |
| | 18 | 0.7 | 1.21 |

What is claimed is:

1. An improved process for the preparation of polyethylene filaments having a high tensile strength and modulus by spinning a solution of linear high-molecular weight polyethylene and thereafter stretching the filament thus formed, the improvement essentially comprising:

spinning a solution of an ethylene polymer or copolymer at a temperature above the gel point of said solution, said solution containing at least 80 percent by weight solvent, and wherein said ethylene polymer or copolymer contains at least 5 percent by weight of at least one alkene having 3 to 8 carbon atoms;

has a weight-average molecular weight Mw greater than $4 \times 10^5$ k/kmole; and has a weight/number average molecular weight ratio Mw/Mn lower than 5;

cooling the spun polymer solution to a temperature below its gel point to form a gel filament; and stretching said gel filament under conditions such that a polymer filament having a tensile strength of at least 1.5 GPa at room temperature is formed.

2. An improved process for the preparation of polymer filaments having a high tensile strength and modulus by spinning a solution of high-molecular weight polymer and stretching the gel filament thus formed, the improvement essentially comprising spinning a solution of a linear polymer or copolymer capable of forming a polymer or copolymer gel, said polymer or copolymer solution containing at least 80 percent by weight solvent relative to said solution, at a temperature above the gel point of said solution, cooling the spun polymer solution thus formed to a temperature below its gel point to form a gel filament, and stretching said gel filament while simultaneously twisting said filament around its axis, under conditions such that a polymer filament having a tensile strength of at least 1.5 GPa at room temperature is formed.

3. The process of claim 1 wherein said ethylene polymer or copolymer has a weight/number-average molecular weight ratio Mw/Mn lower than 4.

4. The process of claim 1 wherein said gel filament is stretched with a stretch ratio which is at least $$\frac{\sqrt{\frac{Mw}{Mn}} \times 4 \times 10^6}{Mw} + 1.$$

5. The process of claim 1 wherein said gel filament, at the commencement of stretching, contains at least 25 percent by weight solvent.

6. The process of claim 1 wherein said gel filament, at the commencement of stretching, contains at least 50 percent by weight solvent.

7. The process of claim 1 wherein said gel filament, at the commencement of stretching, contains virtually no solvent.

8. The process of claim 1 wherein said gel filament during said stretching, is simultaneously twisted around its stretching axis.

9. The process of claim 2 wherein said gel filament is twisted in a manner such that the resulting polymer filament has from between about 300 to 3000 twists per meter of filament length.

10. The process of claim 8 wherein said gel filament is twisted in a manner such that the resulting polymer filament has from between about 300 to 3000 twists per meter of filament length.

11. The process of claim 2 wherein said gel filament, at the commencement of stretching, contains at least 25 percent by weight solvent.

12. The process of claim 2 wherein said gel filament, at the commencement of stretching, contains at least 50 percent by weight solvent.

13. The process of claim 2 wherein said gel filament, at the commencement of stretching, contains virtually no solvent.

14. The process of claim 1 wherein said polyethylene gel filament is stretched at a temperature between 75 and 135° C.

15. The process of claim 2 wherein said high-molecular weight polymer is selected from the group consisting of polyethylene, polypropylene, ethylene-propylene copolymers, polyoxymethylene, polyethyleneoxide, polyamides, polyesters, polyacrylonitrile, polyvinylalcohol, and polyvinylidene fluoride.

* * * * *

UNITED STATES PATENT AND TRADEMARK OFFICE

CERTIFICATE OF CORRECTION

PATENT NO. : 4,436,689

DATED : March 13, 1984

INVENTOR(S) : PAUL SMITH, et al.

It is certified that error appears in the above-identified patent and that said Letters Patent is hereby corrected as shown below:

Column 7, line 27:

Delete "contains at least 5 percent" and insert --contains from about 0 to 5 percent--.

Signed and Sealed this

*Ninth* Day of *October 1984*

[SEAL]

*Attest:*

GERALD J. MOSSINGHOFF

*Attesting Officer*

*Commissioner of Patents and Trademarks*